US005249236A

United States Patent [19]

Sakamoto

[11] Patent Number: 5,249,236

[45] Date of Patent: Sep. 28, 1993

[54] WIRING STRUCTURE OF LOUDSPEAKER

[75] Inventor: Yoshio Sakamoto, Tokyo, Japan

[73] Assignee: Kabushiki Kaisha Kenwood, Tokyo, Japan

[21] Appl. No.: 942,362

[22] Filed: Sep. 9, 1992

Related U.S. Application Data

[63] Continuation of Ser. No. 444,797, Dec. 1, 1989, abandoned.

[51] Int. Cl.[5] ..... H04R 25/00

[52] U.S. Cl. ..... 381/194; 381/195; 381/196; 381/197; 381/192

[58] Field of Search ..... 381/158, 194, 193, 192, 381/195, 196, 197, 199

[56] References Cited

U.S. PATENT DOCUMENTS

| | | | |
|---|---|---|---|
| 2,221,068 | 11/1940 | Alons | 381/197 |
| 2,429,470 | 10/1947 | Knowles | 381/197 |
| 3,014,996 | 12/1961 | Swanson | 381/197 |
| 3,079,471 | 2/1963 | Widener | 381/158 |
| 3,711,659 | 1/1973 | Bremseth | 381/194 |
| 4,539,442 | 9/1985 | Puls et al. | 381/194 |
| 4,665,905 | 1/1986 | Nation | 381/193 |
| 5,014,323 | 5/1991 | Markow et al. | 381/199 |

FOREIGN PATENT DOCUMENTS

| | | | |
|---|---|---|---|
| 3511802 | 10/1986 | Fed. Rep. of Germany | 381/199 |
| 0053599 | 3/1987 | Japan | 381/199 |
| 0638080 | 5/1950 | United Kingdom | 381/197 |

*Primary Examiner*—James L. Dwyer
*Assistant Examiner*—Jason Chan
*Attorney, Agent, or Firm*—Sixbey, Friedman, Leedom & Ferguson

[57] ABSTRACT

A wiring structure of a loudspeaker includes first two conductive areas formed on a damper; second two conductive areas formed on the outer peripheral surface of a voice coil bobbin, the first and second two conductive areas serving as the conductor for supplying an audio signal to a voice coil; wherein the leads of the voice coil are electrically connected to the first two conductive areas, and the second two conductive areas are electrically connected to the first two conductive areas.

2 Claims, 5 Drawing Sheets

WIRING STRUCTURE OF LOUDSPEAKER

This application is a continuation of Ser. No. 07/444,797, filed Dec. 1, 1989, now abandoned.

BACKGROUND OF THE INVENTION

1. Field of the Invention

The present invention relates to a wiring structure of a loudspeaker, and more particularly to a wiring structure of the type having conductive areas on the damper of a loudspeaker which structure facilitates wiring works.

2. Description of the Related Art

As conventional loudspeaker wiring structures, there are known two types of wiring structures, one having conductive areas 32 formed on a damper 31 as shown in FIGS. 5A and 5B and the other having conductive areas 34 formed on a voice coil bobbin 33 as shown in FIGS. 6A to 6D. The conductive areas are used for inputting an audio signal to the voice coil. FIG. 5A is a partial cross section showing the main part of wiring structure, and FIG. 5B is a perspective view of the main part as viewed from the back of the loudspeaker shown in FIG. 5A. FIG. 6A is a cross section showing the main part of wiring structure, and FIGS. 6B to 6D are perspective views showing the wiring procedure for the loudspeaker shown in FIG. 6A.

In the case of the wiring structure shown in FIGS. 5A and 5B, the conductive area 32 is made of a copper foil attached to the front or back surface of the damper 31. A voice coil lead 35 is directly connected to the conductive area 32 with solder 36.

In the case of the wiring structure shown in FIGS. 6A to 6D, the conductive area 34 is made of a copper foil attached to the outer peripheral surface of the voice coil bobbin 33. A hole 37 is formed in the conductive area 34 at the upper end portion thereof, and another hole 39 is also formed at the neck portion of the cone 38 through which hole 39 a tinsel wire 40 is passed. After the cone 36 is glued to the voice coil bobbin 33, the tinsel wire 40 is passed through the hole 39 to the hole 37 so that the conductive member of the tinsel wire 40 is connected to the conductive area 34 at the peripheral portion of the hole 37 with solder 41, and the tinsel wire 40 is fixed at the hole 39 with adhesive agent 42 and is covered with adhesive agent 42 at the hole 37.

With the wiring structure shown in FIGS. 5A and 5B, however, the wiring work using solder 36 requires delicacy and skill, thereby posing the problem of poor workability and less stable product quality.

The wiring structure shown in FIGS. 6A to 6D is complicated, and the wiring work is very cumbersome in that the tensil wire 40 is required to be passed through the hole 39 to the hole 37 and fixed and covered by using adhesive agent 42. Also, the cost of the product becomes high.

SUMMARY OF THE INVENTION

It is an object of the present invention to provide a wiring structure of a loudspeaker capable of eliminating the disadvantages associated with conventional loudspeaker wiring structures and facilitating wiring work while ensuring stable production quality and low cost without necessitating particular skill.

According to one aspect of the present invention the wiring structure of a loudspeaker comprises first two conductive areas formed on a damper, second two conductive areas formed on the outer peripheral surface of a voice coil bobbin, said first and second two conductive areas serving as the conductor for supplying an audio signal to a voice coil, wherein the leads of the voice coil are electrically connected to said first two conductive areas, and said second two conductive areas are electrically connected to said first two conductive areas.

The first conductive area on the damper may be formed by attaching a woven wire to the damped along its corrugation, or may be formed by laminating a conductive piece on a damper which is made by molding heat-resistive resin.

The second conductive area on the outer peripheral surface of the voice coil may be formed by attaching a copper foil thereon. The lead of the voice coil is connected to the second conductive area by using solder or the like. Thereafter, the damper is inserted into the voice coil bobbin while correctly aligning the first and second two conductive areas, and the first and second two conductive areas are connected by using solder or the like.

The other objects and advantages of the present invention will become apparent from the following detailed description when read in conjunction with the accompanying drawings.

DETAILED DESCRIPTION OF THE PREFERRED EMBODIMENTS

Figure 1A:
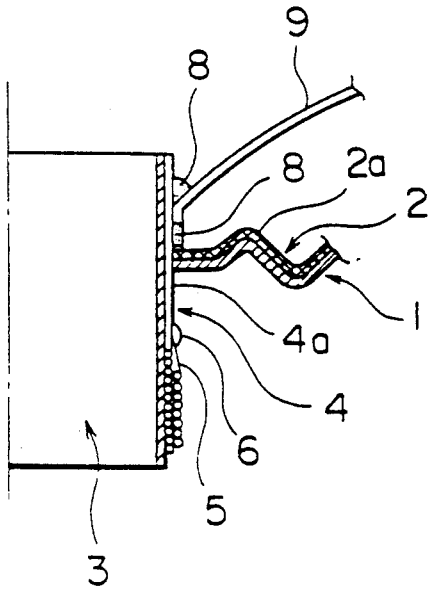
FIGS. 1A and 1B are a cross section and perspective view, respectively showing the main part of the wiring structure of a loudspeaker according to a fist embodiment of this invention.
Figure 1B:
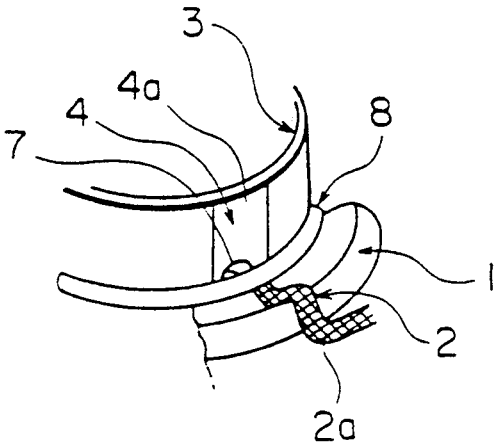

Preferred embodiments of the wiring structure of a loudspeaker according to this invention will be described with reference to FIGS. 1A to 4C.

As particularly shown in FIGS. 1A to 4C a wiring structure of a loudspeaker according to the present invention comprises first two conductive areas 2 formed on a damper 1; second two conductive areas 4 formed on the outer peripheral surface of a voice coil bobbin 3, the first and second two conductive areas 2 and 4 serving as the conductor for supplying an audio signal to a voice coil; wherein the leads 5 of the voice coil are electrically connected to the first two conductive areas 2, and the second two conductive areas 4 are electrically connected to the first two conductive areas 2.

Such wiring structure will be described in detail hereinunder. In the first to third embodiments shown in FIGS. 1A to 3C, the first conductive area 2 formed on the damper 1 is made of a tensil wire 2*a* attached on the damper 1 along its corrugation.

The second two conductive areas 4 are formed by attaching copper foils 4*a* to the outer peripheral portion of a voice coil bobbin 3. The lead 5 of the voice coil is connected to the copper foil 4*a* by using solder 6. Next, the damper 1 is inserted into the voice coil bobbin 3 while correctly aligning the positions of the copper foil 4*a* and tensile wire 2*a*. After they are correctly aligned at the predetermined positions, the tensile wire 2*a* is connected to the copper foil 4*a* with solder 7.

Figure 2A:
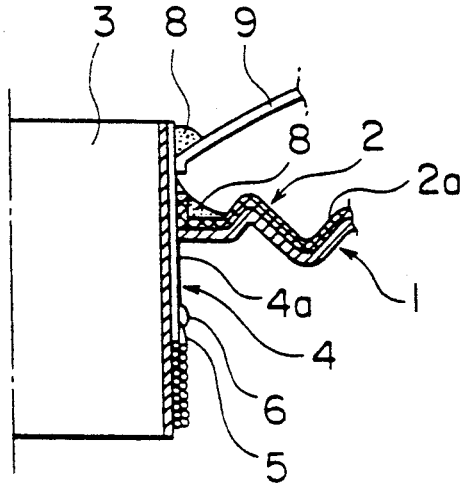
FIGS. 2A to 2D are a cross section, enlarged cross section, perspective view with components being dismounted, and perspective view, respectively showing the main part of the wiring structure of a loudspeaker according to a second embodiment of this invention.
Figure 2B:
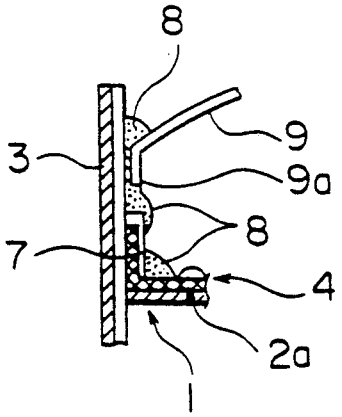
Figure 2C:
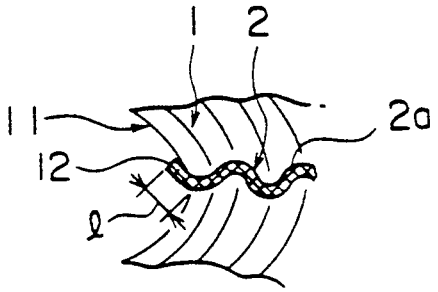
Figure 2D:
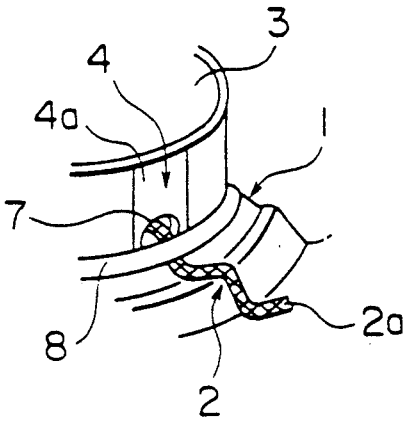
Figure 2D:
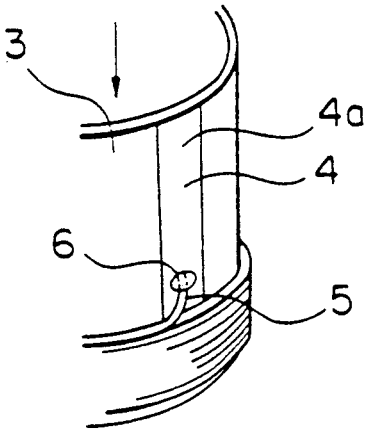

In the above described wiring structures the conductive area 2 on the damper 1 may be provided with a projecting portion 12 as particularly shown in FIG. 2C. The projecting portion 12 is formed by projection the end of the tensil wire 2*a* inside of the base of the damper 1 by a predetermined length 1. In this second embodiment, when the damper 1 is inserted into the voice coil bobbin 3 and held in a predetermined position, the projecting portion 12 extends along the copper foil 4*a* while in contact therewith. Consequently, the contact area between the projecting portion 12 and copper foil 4*a* becomes large, thereby facilitating soldering work and ensuring stable joint.

Figure 3A:
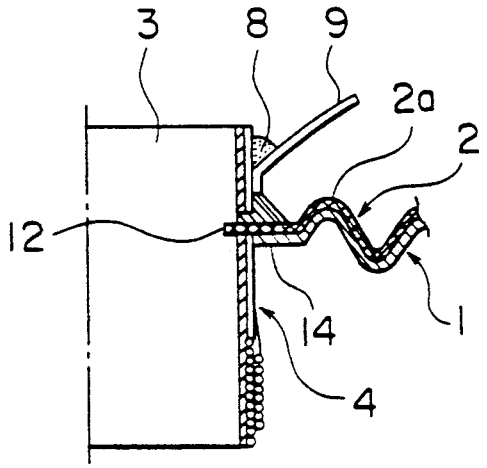
FIGS. 3A to 3C are a cross section, perspective view and enlarged perspective view, respectively showing the main part of the wiring structure of a loudspeaker according to a third embodiment of this invention, FIG. 3C showing adhesive agent covering a joint between conductive areas.
Figure 3B:
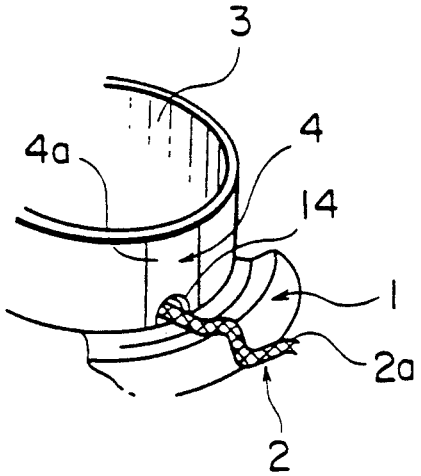
Figure 3C:
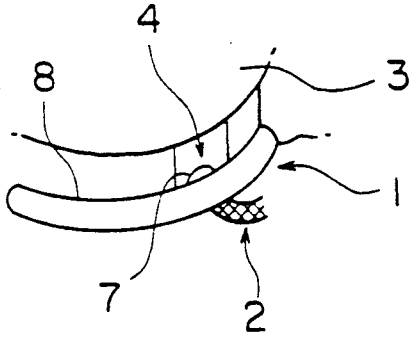
Figure 4A:
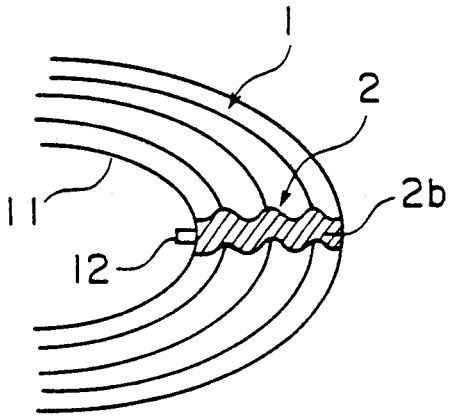
FIGS. 4A to 4C are a perspective view, and cross sections, respectively showing the main part of the wiring structure of a loudspeaker according to a fourth embodiment of this invention, FIG. 4B and 4C showing different joint states.
Figure 4B:
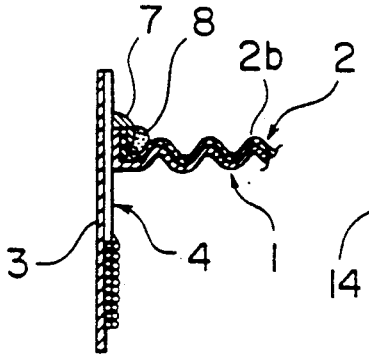
Figure 4C:
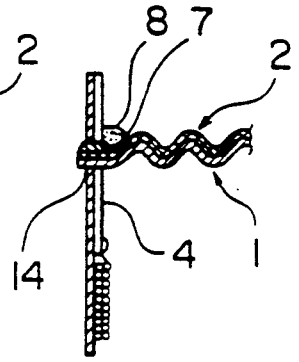
Figure 5A:
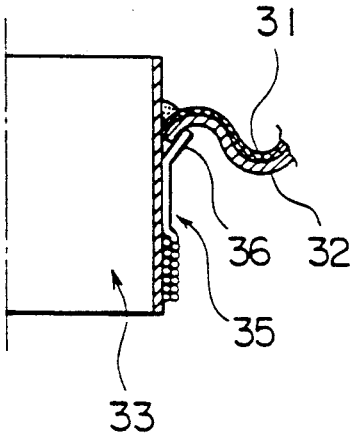
FIG. 5A PRIOR ART
FIG. 5A is a partial cross section showing the main part of a conventional wiring structure.
Figure 5B:
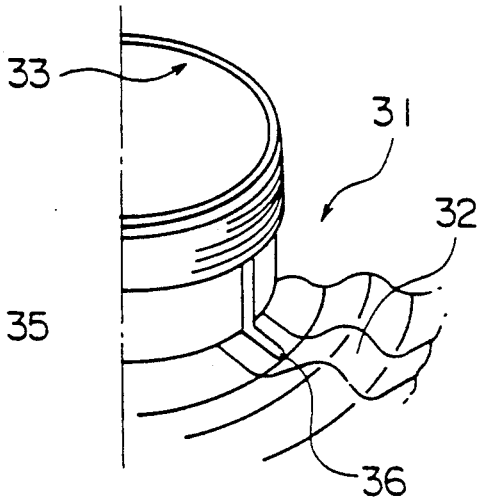
FIG. 5B PRIOR ART
FIG. 5B is a perspective view of the main part as viewed from the back of the loudspeaker shown in FIG. 5A.
Figure 6A:
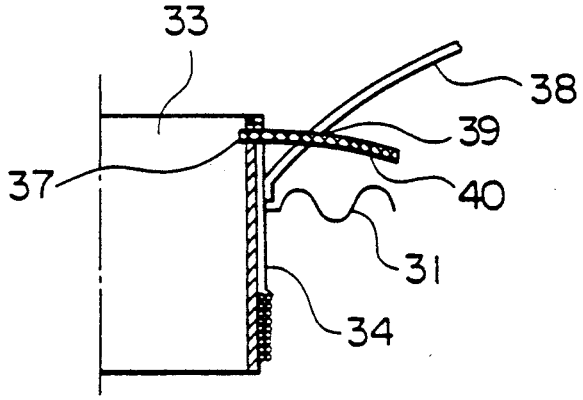
FIG. 6A PRIOR ART
FIG. 6A is a cross section showing the main part of a conventional wiring structure.
Figure 6B:
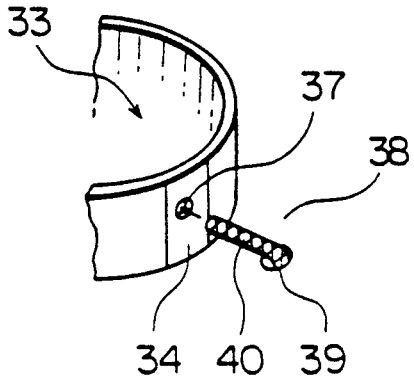
FIG. 6B PRIOR ART
FIGS. 6B to 6D are perspective views showing the wiring procedure for the loudspeaker shown in FIG. 6A.
Figure 6C:
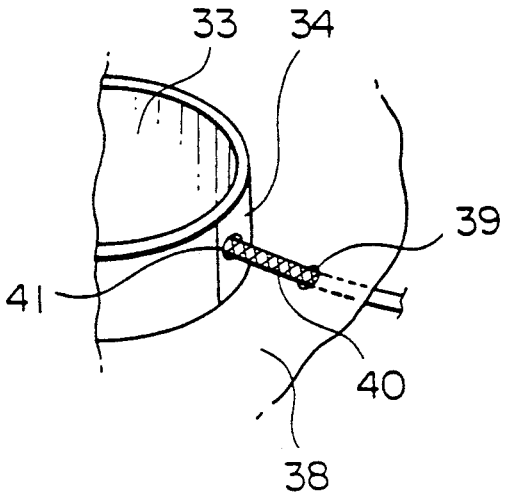
FIG. 6C PRIOR ART
Figure 6D:
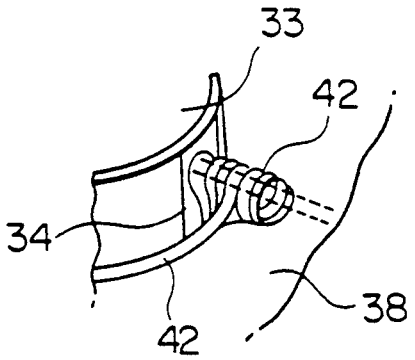
FIG. 6D PRIOR ART

In the third embodiment shown in FIGS. 3A to 3C, a hole 14 is formed in the conductive area (copper foil 4*a*) 4 on the voice coil bobbin 3. The projecting portion 12 described with FIGS. 2A to 2D is inserted into the hole 14 to connect together the copper foil 4*a* and projecting portion 12 with solder 7. Similar to the second embodiment, the soldering work is made easy and the joint is maintained stable.

After the wiring as described above, the outer peripheral portion of the voice coil 3 and the base (inner peripheral portion) 11 of the damper 1 are glued together. If the joint between both the portions are coated with adhesive agent 8, the soldered joint between the copper foil 4*a* and woven wire 2*a* is also covered with the adhesive agent 8 so that the soldered joint can be reinforced. In the case where the projecting portion 12 is extended along the copper foil 4*a* and connected to the conductive area 4, although only a part of the soldered joint is covered with the adhesive agent 8, this makes no practical problem. However, the adhesive agent 8 of proper amount may be coated at the neck potion of the cone 9 at the gluing process for the cone 9 and voice coil bobbin 3, so that the adhesive agent 8 flows out of the back portion 9*a* of the neck of the cone 9 and covers the whole joint between the projecting portion 12 and copper foil 4*a*, to thereby reinforce the joint between the copper foil 4*a* and tensil wire 2*a* similarly to the first and third embodiments In the fourth embodiment shown in FIGS. 4A to 4C, the conductive area 2 is formed by laminating a conductive piece 2*b* on the damper 1 which is formed by molding heat-resistive resin.

In this case, the projecting portion 12 may be formed by projecting the end of the conductive piece 2*b* inside of the base portion of the damper 1. This projecting portion 12 is third embodiments. If the projecting portion as shown in FIGS. 2A to 2D is used, the projecting portion of the conductive piece 2*b* is molded upright at the base of the damper 1.

As described so far, the wiring structure of a loudspeaker according to this invention facilitates the wiring work between the voice coil lead and conductive area on the damper while ensuring stable product quality, thereby allowing automatic wiring operations and lower man power.

Further, by coating adhesive agent at the joint between bobbin and damper or between bobbin and cone neck, the soldered joint between the bobbin and damper conductive areas is also coated with the adhesive agent, thus not necessitating another coating process as conventional, which result in low cost of a product.

While the presently preferred embodiments of the present invention have been shown and described, it is to be understood that this disclosure is for the purpose of illustration and that various changes and modifications may be made without departing from the scope of the invention as set forth in the appended claims.

What is claimed is:

1. A loudspeaker comprising:

a voice coil unit comprising a voice coil bobbin, a voice coil wound on the voice coil bobbin and a conductive foil strip attached to the outer surface of the voice coil bobbin, said voice coil being wound around a portion of the voice coil bobbin at a first end thereof and said conductive foil strip extending along the surface of the voice coil bobbin from said voice coil to a portion of the voice coil bobbin at a second end thereof, and a damper unit comprising a flexible base member with an aperture through which the voice coil bobbin is unlaid and a lead wire attached to the surface of the base member at a side thereof which faces away from said voice coil, the lead wire being a tensile wire and one end of the lead wire extending to the periphery of the aperture in the base member so that said one end of the lead wire abuts against the conductive foil strip when said voice coil unit is inlaid into the aperture, wherein said one end of the lead wire is joined with solder to the conductive foil strip at one point of the junction line of the voice coil bobbin and said base member at said side thereof which faces away from said voice coil, and adhesive agent is disposed along the junction line of the voice coil bobbin and said base member to mechanically couple them and to cover the soldering joint point.

2. A loudspeaker according to claim 1, wherein said lead wire attached to the base member is provided with a projecting portion projecting inside the aperture, and said conductive strip attached to the voice coil bobbin includes a hole, wherein said projecting portion is inserted into said hole and said lead wire and conductive strip are connected by using said solder.

* * * * *